US006092564A

United States Patent [19]

Bourgeaux et al.

[11] Patent Number: 6,092,564

[45] Date of Patent: Jul. 25, 2000

[54] PROCESS AND APPARATUS FOR MOUNTING A FUNICULAR ELEMENT IN A JACQUARD ELECTRICAL SHED FORMING DEVICE

[76] Inventors: Pierre Bourgeaux, 77 route de la Montagne, Poisy 74330; Jean-Paul Froment, 142 route des Cotes, Doussard 74210, both of France

[21] Appl. No.: 09/218,302

[22] Filed: Dec. 22, 1998

[30] Foreign Application Priority Data

Dec. 24, 1997 [FR] France ..... 97 16739

[51] Int. Cl.[7] ..... D03C 3/20

[52] U.S. Cl. ..... 139/455; 139/85; 254/900

[58] Field of Search ..... 254/900; 169/455, 169/59, 65, 85

[56] References Cited

U.S. PATENT DOCUMENTS

| | | | |
|---|---|---|---|
| 1,678,544 | 7/1928 | Whitaker . | |
| 1,910,222 | 5/1933 | Kunath . | |
| 3,867,966 | 2/1975 | Wieland | 139/55 |
| 4,433,704 | 2/1984 | Decuq . | |
| 5,069,256 | 12/1991 | Goodman, Jr. . | |

FOREIGN PATENT DOCUMENTS

| | | |
|---|---|---|
| 0050088 | 10/1981 | European Pat. Off. . |
| 0353005 | 7/1989 | European Pat. Off. . |
| WO8102312 | 8/1981 | WIPO . |
| WO8903441 | 4/1989 | WIPO . |

*Primary Examiner*—Andy Falik
*Attorney, Agent, or Firm*—Dowell & Dowell, P.C.

[57] ABSTRACT

A process for mounting a funicular element in a shed forming device of a weaving loom of a Jacquard type wherein at least one end of the funicular element is fixed on a pulley adapted to receive the funicular element and which pulley is driven in rotation by an electrical rotary actuator. A device is provided for removably connecting the funicular element to the actuator.

17 Claims, 7 Drawing Sheets

PROCESS AND APPARATUS FOR MOUNTING A FUNICULAR ELEMENT IN A JACQUARD ELECTRICAL SHED FORMING DEVICE

BACKGROUND OF THE INVENTION

1. Field of the Invention

The present invention relates to a process for mounting a funicular element and to a device for forming the shed on a weaving loom for controlling the harness cords of a weaving system of Jacquard type.

2. Brief Discussion of the Related Art

In weaving systems of Jacquard type, it is known to drive, in phase opposition, two frames each bearing a plurality of griffes or horizontal knives adapted to displace, vertically, the hooks connected to the harness cords by a pulley or block mechanism. Mechanical or electro-mechanical devices are provided to immobilize these hooks along their vertical stroke. This known type of device necessitates considerable power for maneuvering the griffe frames, which power is furnished by the drive shaft of the weaving loom, this leading to said loom being overdimensioned.

It is also known to use a rotating motor such as a step motor or a servomotor to control a small cord belonging to a weaving loom, linearly. In this known device, the small cord is provided to be surrounded, in the manner of a capstan, around a mobile part of the rotary actuator. Taking into account the sliding movement inherent in this type of winding, it is not possible to control the position of the small cord with precision. In addition, it is difficult to assemble and disconnect the small cord, and its positioning is imprecise.

It is a more particular object of the invention to overcome these drawbacks by proposing a process of assembly which allows a precise and efficient control of a funicular element such as a harness cord of a weaving system of the Jacquard type.

SUMMARY OF THE INVENTION

To that end, the invention relates to a process for assembling a funicular element in a device for forming the shed in a weaving loom of Jacquard type, characterized in that it consists in fixing at least one end of the funicular element on winding element such as a pulley, adapted to receive it wound over at least one turn and driven by the rotor of an electrical rotary actuator, and in providing means for removable connection between the funicular element and the actuator.

Thanks to the process of the invention, it is possible to constitute a shed-forming device by successively assembling at least one end of the funicular elements with rotors belonging to various electrical rotary actuators. The removable nature of the connection made thanks to the process of the invention allows the device to be easily dismantled, in particular for maintenance operations. The fact that one end of the funicular element is fixed with respect to the element of the actuator driven in rotation, guarantees a good precision of the drive, which is essential for an efficient formation of the shed.

According to an advantageous aspect, the process consists in connecting one end of the funicular element with a first member and in removably mounting this first member on a second member secured to the rotor of the actuator. In this way, the connection between the rotor of the actuator and the end of the funicular element is made by assembling these first and second members.

The invention also relates to a device for carrying out the process described hereinbefore and, more especially, to a device for forming the shed on a weaving loom of Jacquard type, which device comprising at least one electrical rotary actuator provided for driving at least one funicular element around a winding element, characterized in that at least one end of the funicular element is fixed on a pulley, adapted to receive the funicular element wound over at least one turn and driven in rotation by the actuator, and in that removable connection means are disposed between the funicular element and the actuator.

According to a first advantageous aspect of the device of the invention, the removable connection means comprise a first member provided with at least one means for retaining the end of the funicular element, and a second member which a rotor of said actuator, said first and second members being provided to be removably assembled. Thanks to this aspect of the invention, the e nd of the funicular element may be assembled on the first member in an assembly station provided to that end, while the second member is mounted on the rotor of the actuator when this actuator is being manufactured. Final assembly of the first and second members may be effected when the shed forming device is being manufactured, possibly on the site where the weaving loom is used. This aspect of the invention makes it possible to replace the complete harness of a weaving system of the Jacquard type by dismounting the different first members, the corresponding second members remaining in place on the actuator and receiving new first members connected to funicular elements, such as harness cords, belonging to a new harness.

According to another advantageous aspect of the invention, the second member is provided with an elastic element for hooking of the first member. This structure allows removable fixation of the first and second members.

According to another advantageous aspect of the invention, the first and second members are provided with check means allowing assembly thereof in an adapted relative position. This aspect of the invention facilitates the work of an operator when positioning a large number of devices according to the invention, insofar as he does not have to systematically verify the correct position of the first member as long as he was able to mount it on the corresponding second member. This guarantees a precise control of the funicular element.

According to certain embodiments of the invention, the device comprises means for fixing at least two ends of funicular element(s). This allows control of the heddles of a Jacquard loom with high precision. In that case, it may be provided that the ends belong to a single funicular element disposed around an elastically loaded guide pulley so as to exert an effort of tension on the funicular element, these ends being provided to be wound in opposite directions on the pulley. It may also be provided that the two ends belong to distinct funicular elements connected to individual tensioning means. The two ends of the funicular element advantageously present a common zone of winding on the winding assembly. This aspect of the invention makes it possible to optimize the dimensioning of the winding assembly. In certain variant embodiments, a first side of the funicular element controls the position of the warp yams, while its second side passes through a lap of warp yams between a winding pulley and the guide pulley. According to certain embodiments, the ends of funicular element(s) each control the position of a mail for passage of a warp yarn.

According to another advantageous aspect of the invention, applicable whatever the embodiment considered, the pulley is provided with a helicoidal groove for guiding the funicular element during winding.

The invention also relates to a weaving loom equipped with a shed forming device as described hereinbefore. This loom is simpler to employ and maintain than the devices of the prior art and allows a wire-to-wire control of a harness of a Jacquard loom with a yield substantially improved with respect to the known art. The distribution of the orientation of the removable connection means with respect to the polarities of the magnetic elements of the actuators is advantageously irregular or regularly offset.

BRIEF DESCRIPTION OF THE DRAWINGS

The invention will be more readily understood on reading the following description of five embodiments of a shed forming device on a weaving loom in accordance with its principle, given solely by way of example and with reference to the accompanying drawings, in which.

DESCRIPTION OF PREFERRED EMBODIMENT

Figure 1:
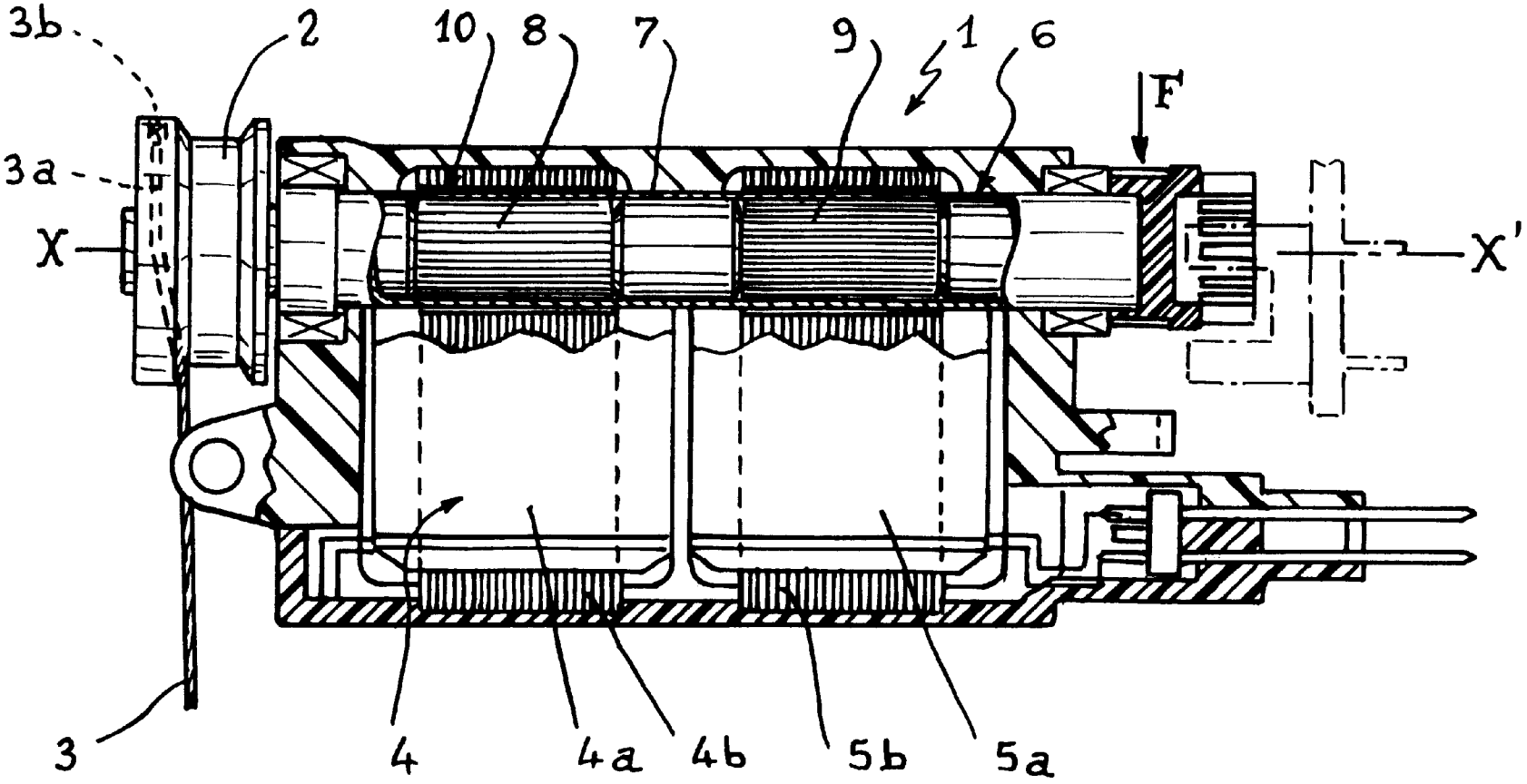
FIG. 1 is a longitudinal section of an actuator adapted to be used with the device of the invention.

Referring now to the drawings, the electrical rotary actuator 1 shown in FIG. 1 is intended to ensure winding, on a winding element pulley 2, of a harness cord 3 connected to one or more warp yams of a weaving system of the Jacquard type.

The pulley 2 may receive the harness cord 3 wound over at least one turn, as it presents a continuous peripheral winding surface over 360°. It may also receive the harness cord 3 over a fraction of a turn. The winding of the harness cord on the pulley 2 may be helicoidal or spiral.

The actuator 1 is a two-phase actuator. It comprises two stator elements 4 and 5, universally aligned and adapted to cooperate with a rotor 6 formed by a tube 7, preferably made of a magnetic material such as, for example, brass. The tube 7, which extends along an axis XX', contains two permanent magnets 8, 9, disposed opposite the two elements 4 and 5. These elements 4 and 5 comprise windings 4*a* and 5*a* of electrically conducting wire such as copper wire, wound around stacks 4*b* and 5*b* of magnetically conducting plates. The shape of the stacks 4*b* and 5*b* is such that they form a circular housing 10 for receiving the tube 7. The size of the housing 10 defines the air gap of the stator elements 4 and 5 with respect to the rotor 6.

Figures 2, 3:
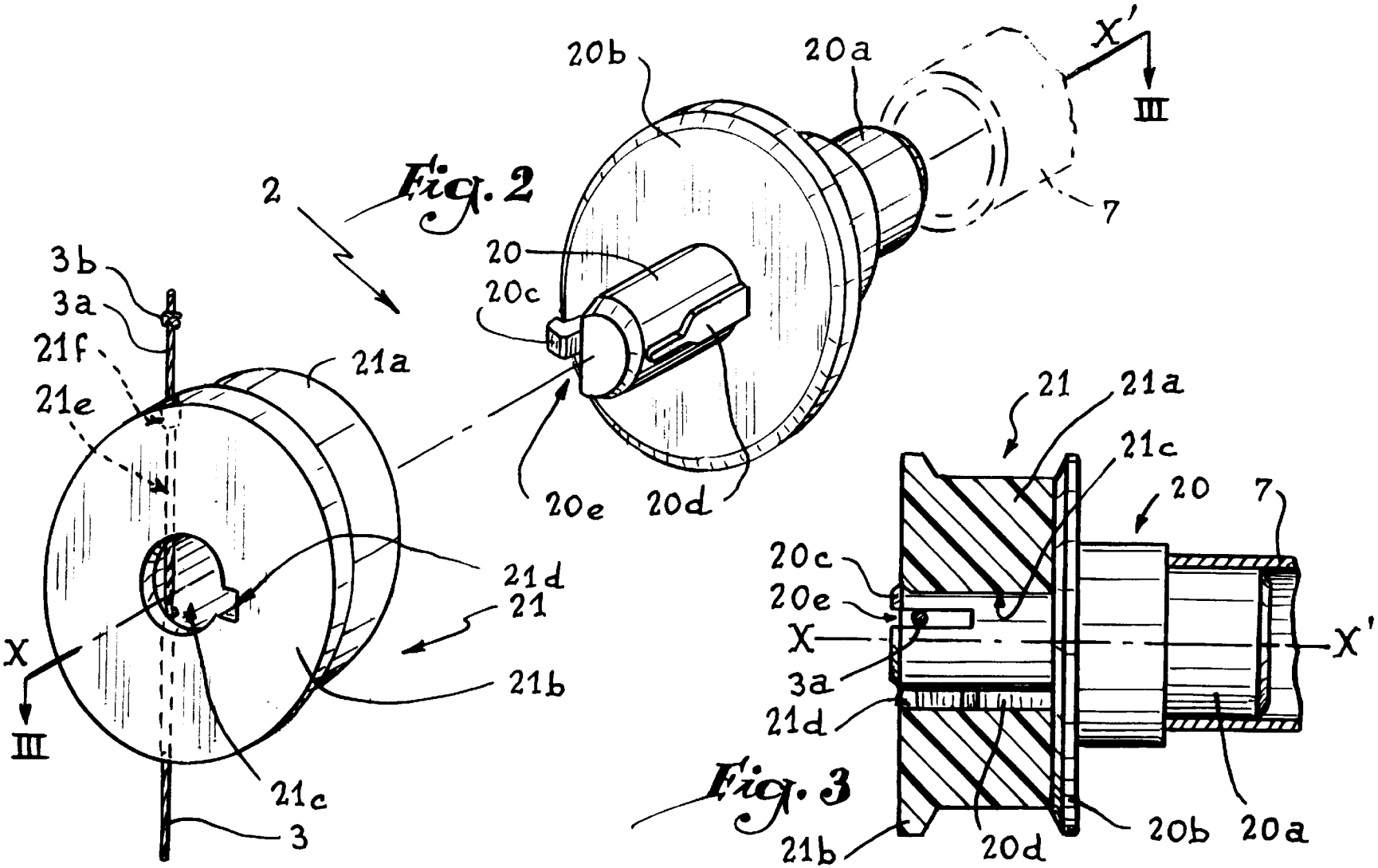
FIG. 2 shows, in an exploded perspective view, an end head of the rotor of the actuator of FIG. 1.
FIG. 3 is a section along line III—III in FIG. 2, the elements being mounted.

As is more clearly apparent in FIGS. 2 and 3, the tube 7 receives an overall cylindrical hub 20 which comprises an axial part 20*a* force-fitted inside the tube 7. The hub 20 is intended removably to receive a roller 21 formed by a cylindrical winding part 21*a* and an end part or cheek 21*b*. The hub 20 is also provided with a part 20*b* forming cheek, with the result that, when the roller 21 is in place on the hub 20 as shown in FIG. 3, these parts form the pulley 2 bordered by the two cheeks 20*b* and 21*b*.

The hub 20 is provided with an elastic hook 20*c* adapted to penetrate in a recessed central part 21*c* of the roller 21. The hub 20 also has a ramp 20*d* adapted to cooperate with a groove 21*d* made in the wall of part 21*c* of the roller 21, with the result that the latter may be mounted on the hub 20 in a single position. The ramp 20*d* also participates in the driving of the roller 21 in rotation, by performing the role of a key.

The harness cord 3 is mounted on the roller 21, forming at its end 3*a* a knot 3*b*. A housing 21*e* is provided in the roller 21 to receive the end 3*a* of the harness cord 3, the housing 21*e* having an opening 21*f* of larger diameter allowing the knot 3*b* to be accommodated. The harness cord 3 passes through the hollow central part 21*c* of the roller 21 and passes in a slot 20*e* made between the hoot 20*c* and the principal part of the hub 20 in order to give the hook 20*c* the elasticity necessary for its function. The harness cord 3 is thus firmly maintained in position while the roller 21 is easily placed in position on the hub 20, by a simple pressure in the direction of the shaft 7.

In this way, during assembly of a weaving system, it is possible to mount the harness cord 3 by simply removably fixing the roller 21 on the hub 20, which makes it possible to wind the end 3*a* of the harness cord 3 more or less around the pulley 2.

According to a variant embodiment of the invention (not shown), it may be provided to replace the knot 3*b* by a welding spot 2 of the end 3*a* of the harness cord 3 on roller 21. It may also be provided to overmold the end 3*a* of the harness cord 3 in the roller.

Figure 4:
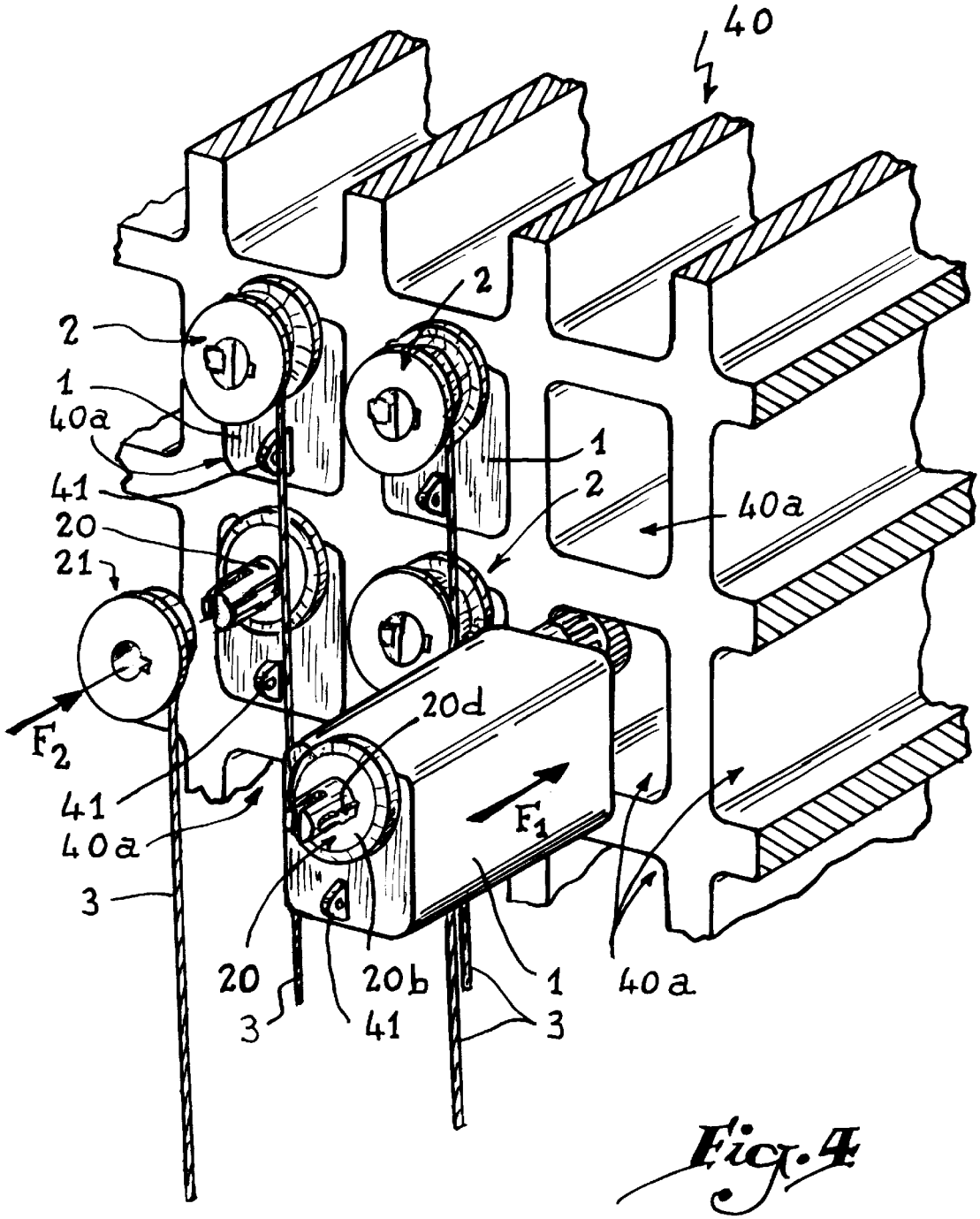
FIG. 4 illustrates an example of positioning a harness cord end with actuators of the type of FIG. 1.

The actuator 1 visible in FIG. 1 may advantageously be installed in a bank, as visible in FIG. 4, i.e. by disposing a large number of actuators side by side inside a structure 40 defining compartments 40*a* for receiving the actuators. The actuators are inserted in the compartments 40*a* in a direction $F_1$ and may be extracted therefrom thanks to a pierced tab 41 provided on the front face.

When the actuators 1 are in position in the compartments 40, it is possible to clip the different rollers 21 on the hubs 20, as represented by arrow $F_2$, and this without other intervention on the actuators 1.

When it is desired to dismount the harness cord 3, it suffices to draw on the roller 21 in the direction opposite arrow $F_2$. The hook 20*c* which has a bearing face inclined against the roller 21, is automatically pushed in the direction of axis XX', with the result that it does not oppose extraction of the roller 21 towards the left in FIG. 3.

Figure 5:
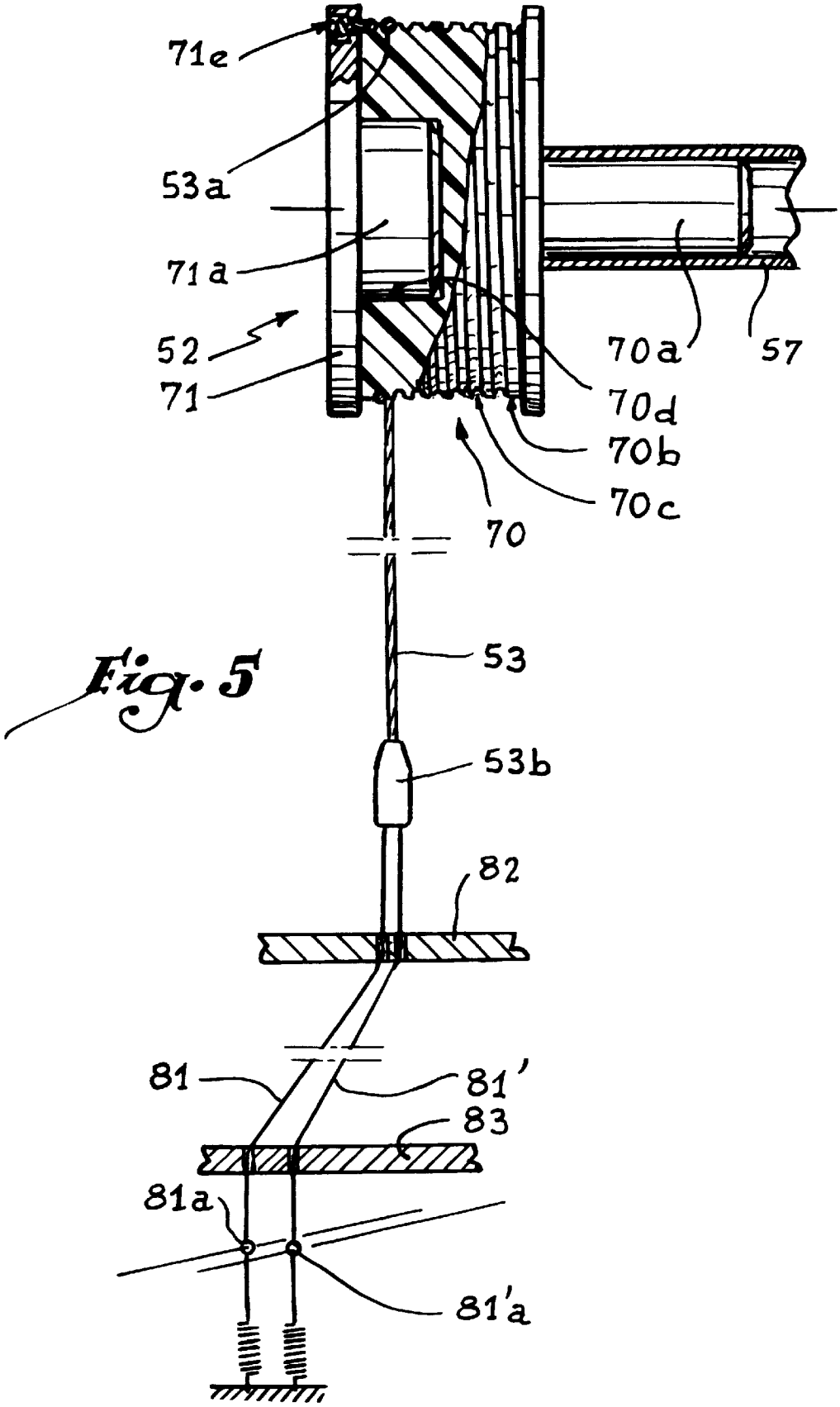
FIG. 5 is a section similar to FIG. 3 for a device according to a second embodiment of the invention.

In the second embodiment of the invention shown in FIG. 5, elements similar to those of the embodiment of FIGS. 1 to 4 have identical references increased by 50. In this embodiment, a tube 57 belonging to the rotor of an electrical rotary actuator receives, at its end, a hub 70 of which an axial part 70*a* is provided to be glued inside the tube 57. A cheek 71 is provided to be added on the hub 70 so as to form a pulley 52 for winding of the upper end 53*a* funicular element or of a harness cord 53. The end 53*a* of the harness 53 is received in a housing 71*e* in the cheek 71 and glued therein. The lower end 53*b* of the harness cord 53 is connected to two heddles 81 and 81' respectively equipped with a mail 81*a* or 81'*a* for passage of a warp yarn. The heddles 81 and 81' traverse a yarn guide 82 located in the vicinity of the actuator and a harness tie board 83.

The outer radial surface 70*b* of the hub 70 constitutes the winding surface of the pulley 52 and is provided with a helicoidal groove 70*c* for guiding the harness cord 53 in the course of winding, over a fraction of turn or over several turns, as a function of needs.

The cheek 71 comprises an axial part 71*a* intended to penetrate in a housing 70*d* of the hub 70 for a removable assembly of the cheek 71 on the, hub 70. It may be provided that the housing 70*d* comprises grooves or notches of shape complementary to that of ribs or notches provided on the outer surface of the part 71*a*, so as to guarantee drive in rotation of the cheek 71 by the hut, 70. A key device may also be envisaged.

As in the device of the first embodiment, means are provided for angular indexing, drive in rotation and axial hold of the pulley 52.

In this embodiment, the essential elements of the pulley 52, and in particular the winding surface 70*b*, are constituted by the hub 70, while the part fast with the end 53*a* of the harness cord 53 is reduced to cheek 71 alone.

In place of the housings 21*e* and 71*e* of the first and second embodiments, a stud may be formed on the roller 21 or the cheek 71, the end 3*a* or 53*a* of the harness cord then forming a loop provided to be disposed around this stud. Other retaining means may also be formed on the roller 21 or the cheek 71 to cooperate with the end of the harness cord.

According to another embodiment of the invention (not shown), it may also be provided that the actuator comprises a hub fixed by any appropriate means on the rotor of an actuator, while the upper end of the harness cord or another funicular element is simply knotted on this hub which comprises, for example, a hole for receiving this end. Likewise in this case, the upper end of the funicular element may be removably fixed on an element driven in rotation by the electrical rotary actuator.

Figure 6:
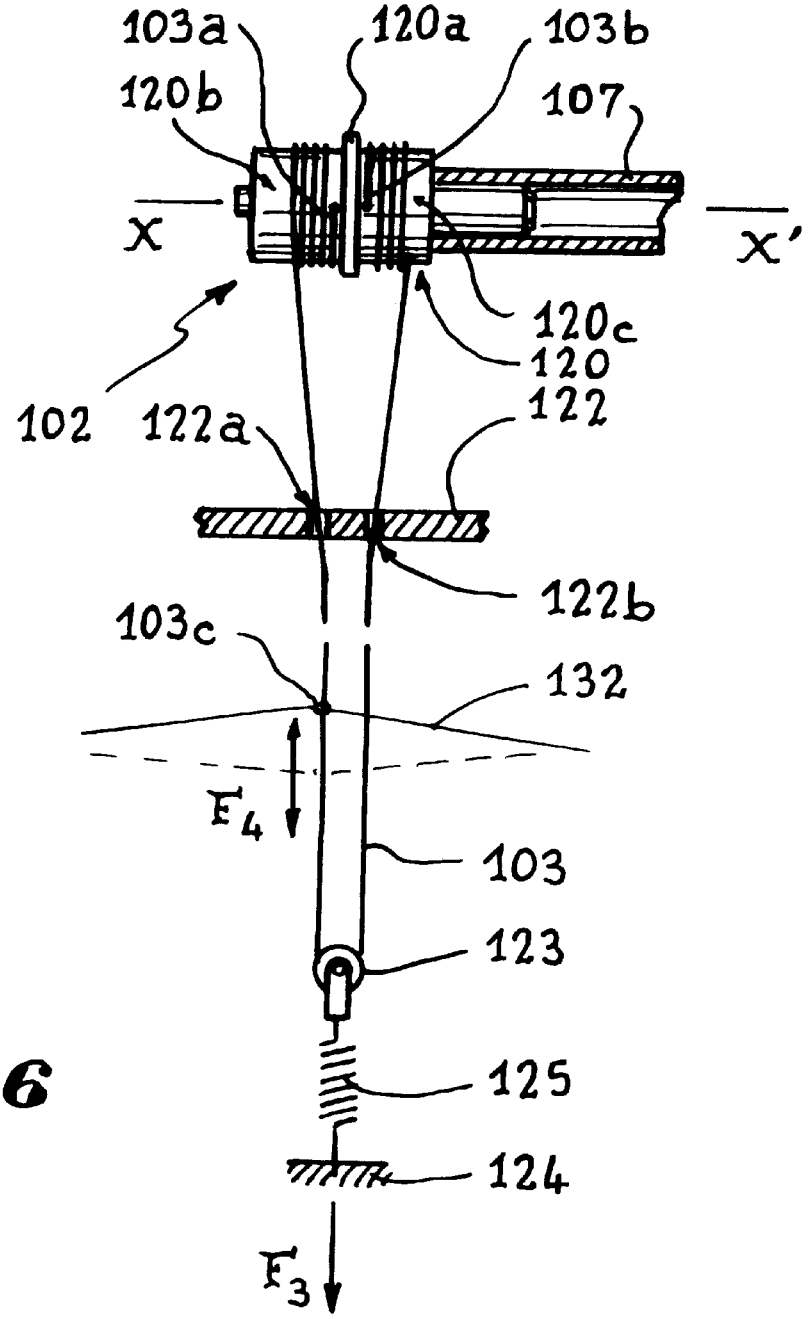
FIG. 6 schematically represents the principle of a device according to a third embodiment of the invention.

In the third embodiment of the invention shown in FIG. 6, elements similar to those of the embodiment of FIGS. 1 to 4 have identical references increased by 100. In this embodiment, the two ends 103*a* and 103*b* of a funicular element or cable 103, forming a heddle and provided with a mail 103*c* for passage of a warp yarn 132, are secured to a hub 120 forming a pulley 102 and fixed on a tube 107 belonging to the rotor of an electrical rotary actuator. The hub 120 comprises a flange 120*a* defining two zones 120*b* and 120*c* for winding the ends 103*a* and 103*b* of the cable 103. A harness tie board 122 is provided for guiding the cable 103 below the hub 120 and comprises two orifices 122*a* and 122*b* for passage of the cable 103.

The cable 103 also passes around an idle pulley 123 maintained, with respect to a fixed frame 124, by a return spring 125 exerting on the pulley 123 a downwardly directed vertical effort $F_3$, so that the pulley exerts on the cable 103 an effort of tension.

The ends 103*a* and 103*b* of the cable 103 are wound on the hub 120 in two different directions, with the result that the winding of one of these ends corresponds to the unwinding of the other end, and vice versa. In this way, the movement of rotation of hub 120 about axis XX' induces a vertical oscillating movement as represented by arrow $F_4$ of the mail 103*c*.

In the case of a particularly simple weaving movement, particularly for cloth, and in accordance with a variant of the invention (not shown), the cable 103 may be provided to bear, on each side, a mail for passage of a warp yarn, on either side of the pulley 123. In this way, the movements of the mails are in phase opposition.

Figure 7:
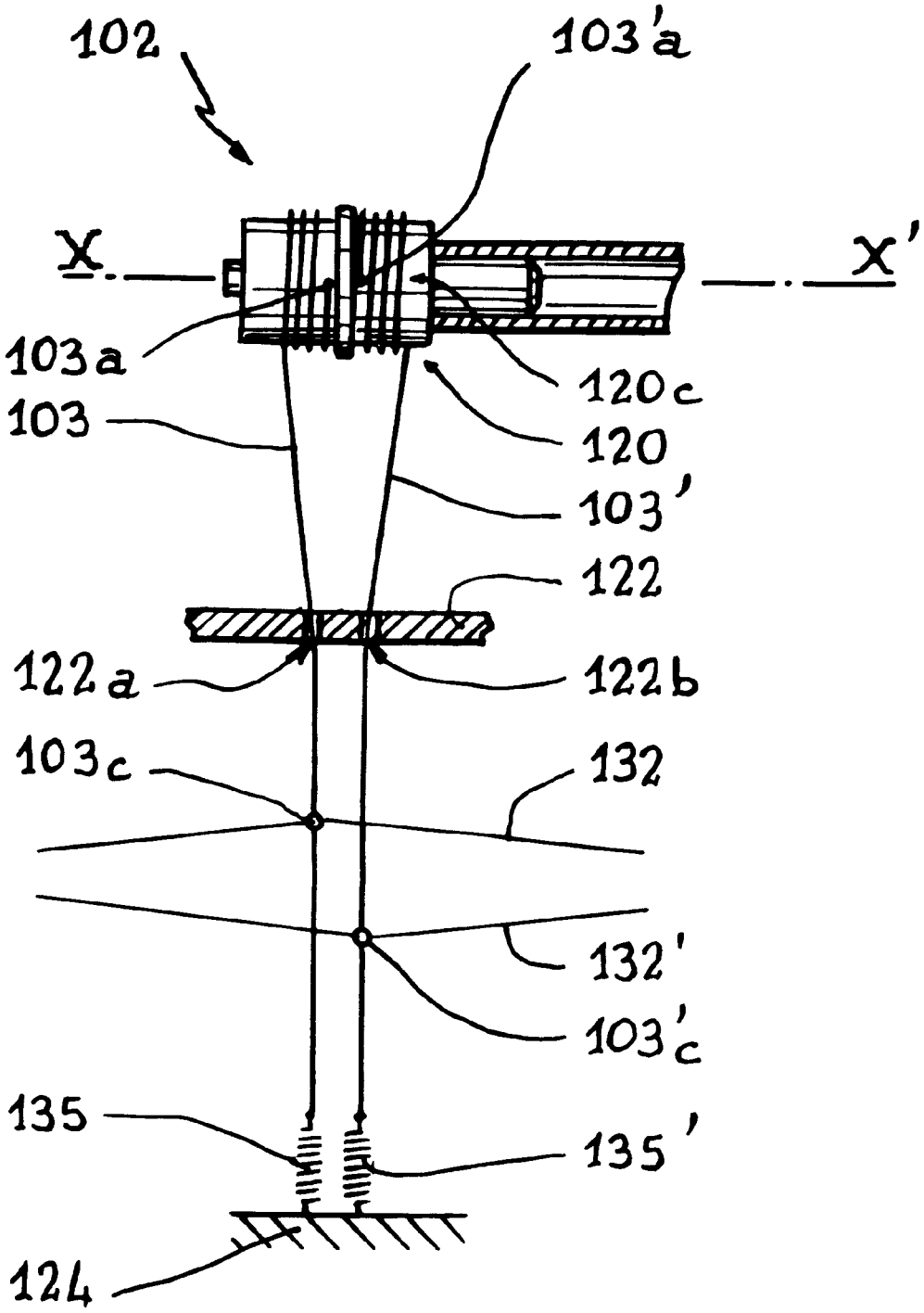
FIG. 7 is a view similar to FIG. 6 for a device according to a fourth embodiment of the invention.

In the fourth embodiment of the invention shown in FIG. 7, elements similar to those of the embodiment of FIG. 6 have identical references. Two funicular elements or cables 103 and 103' are secure to and driven by pulley 102, identical to that of the third embodiment. The movement in phase opposition of the sides corresponding to the ends 103*a* and 103'*a* of the cables 103 and 103' is used for making a selvedge. In that case, the cables each carry a mail 103*c* or 103'*c* for controlling the position of a warp yarn 132 or 132' and each constitute a funicular element connected to the frame 124 of the machine by an elastic return means, such as a spring 135 or 135'.

Figure 8:
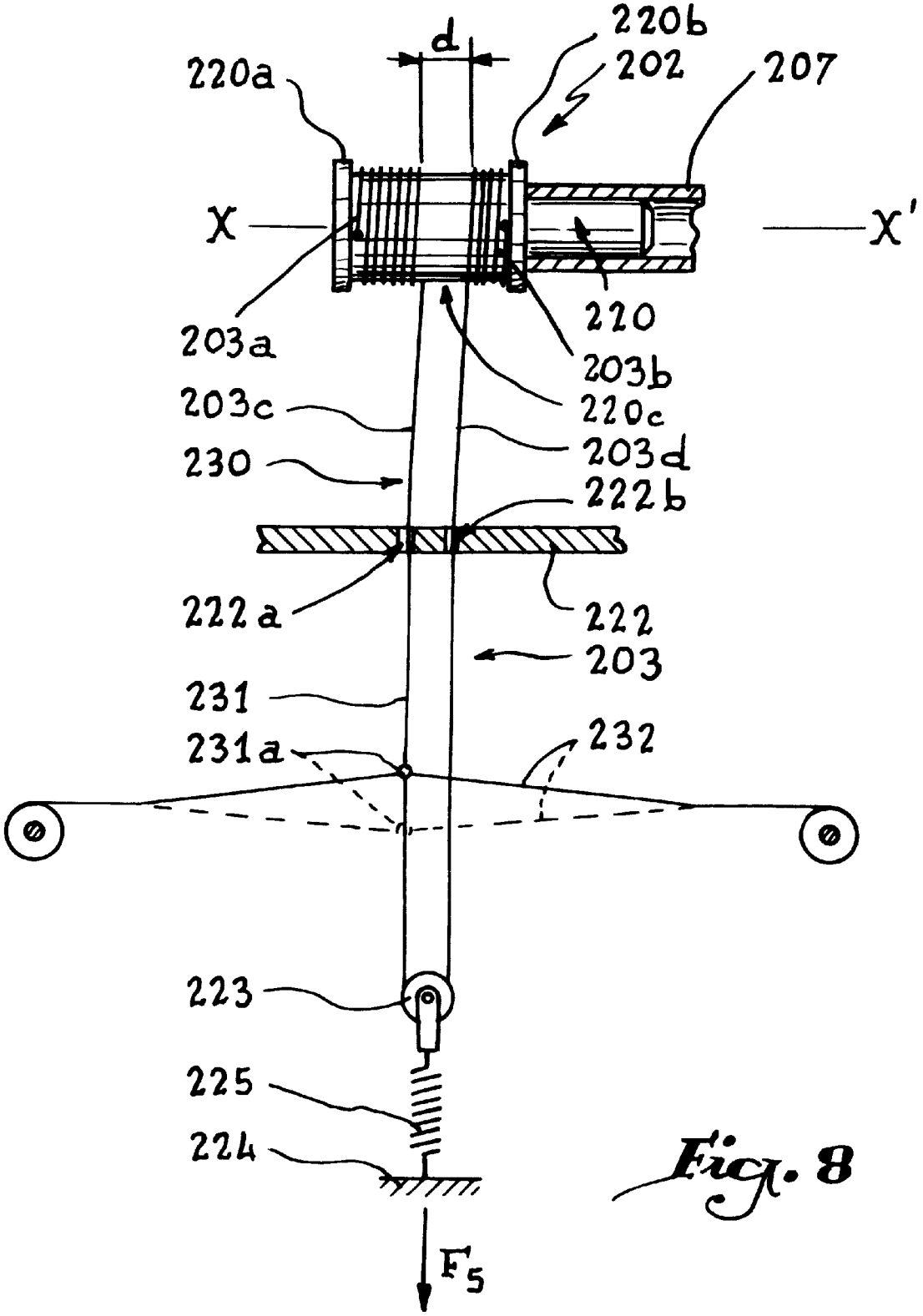
FIG. 8 is a view similar to FIG. 6 for a device according to a fifth embodiment of the invention.

In the fifth embodiment of the invention shown in FIG. 8, elements similar to those of the embodiment of FIGS. 1 to 4 have references identical increased by 200. In this embodiment, the ends 203*a* and 203*b* of an assembly 203, formed by a funicular element or harness cord 230 and a heddle 231 of a Jacquard loom, are fixed to a pulley 202 constituted by a hub 220 fast with a tube 207 belonging to the rotor of an electrical rotary actuator.

The hub 220 is bordered by two cheeks 220*a*, 220*b* at the level of which are fixed the ends 203*a* and 203*b* which are wound on a central zone 220*c* of the hub 220. At their point of connection with the surface 220*c*, the sides 203*c* and 203*d* of the assembly 203 are separated by a distance d corresponding substantially to the spacing of the orifices 222*a* and 222*b* of a harness tie board 222. These orifices guide the sides 203*c* and 203*d* above a warp yarn 232 traversing a mail 231*a* of the heddle 231.

As a function of the winding of the ends 203*a* and 203*b* on the pulley 202, i.e. on the hub 220, the mail 231*a* may take the two positions represented respectively by the positions of the warp yarn 232 in solid lines and in mixed lines.

As before, an idle pulley 223 is intended to be surrounded by the lower part of the harness cord 230, being connected to the frame of the machine 224 by a spring 225. The spring 225 exerts on the pulley 223 an effort $F_5$ of tension of the harness cord 230.

Rotation of the hub 220 about axis XX' of the tube 207 induces the unwinding of one of the ends of the assembly 203 and the corresponding winding of the other end. In this way, the distance d is maintained globally constant during the movements of rotation of the hub 220. In other words, the surface 220*c* of the hub 220 is a common zone of winding of the ends 203*a* and 203*b*, it being understood that a distance d is permanently maintained between these ends. This makes it possible to provide the hub 220 to be about half the length of the hub 120 of FIG. 6 and to avoid the harness cord 203 being deviated too much at the orifices 222*a* and 222*b*.

Of course, the cable of this fifth embodiment may equally well carry two mails which would serve to control two distinct warp yarns, as in the embodiment of FIG. 7.

In the embodiments of FIGS. 6 and 8, the funicular element 103 or 203 are wound on a single guide pulley 123 or 223, which is particularly simple from the structural standpoint and induces a low inertia. The funicular element 103 or 203 controls, by the mail 103*c* or 231*a* that it carries, on a first side, the position of the warp yarns 132 or 232, while its second side also traverses the lap of warp yarns. At the level of this lap, the funicular element may advantageously be composed of a metallic wire, preferably cylindrical, fine and smooth.

In the embodiments of FIGS. 6 and 8 and in order to guide the ends of the funicular elements in their winding and unwinding, helicoidal grooves may be provided on the zones 120*b*, 120*c* and 220*c* of the hubs 120 and 220. As in the other embodiments, the fixation of the ends of the funicular element on the hubs guarantees a precise guiding of these elements, in particular when it is a Jacquard loom harness cord. The removable nature of this fixation obtained, for example by systems similar to those of the preceding embodiments, renders the whole well adapted to dismantling. Pulley 102 and 202 might in particular be made in two parts equivalents to members 20 and 21 or 70 and 71.

In the embodiments of FIGS. 6 to 8, the two ends of the funicular element(s) have been shown as winding in opposite directions, which makes it possible to obtain opposite movements of mails connected to these ends. In the embodiment of FIG. 7, it is, however, possible to wind two or more of two ends of funicular elements in the same direction on a pulley, which makes it possible to control a plurality of mails in phase, as in the embodiment of FIG. 5, without having to resort to a connection of the type shown at the lower end 53*b* of the harness cord 53.

Moreover, it is possible, without departing from the scope of the present invention, to associate a plurality of juxtaposed pulleys intended to be driven by the rotor of a single actuator. These pulleys may be identical or different and may each control one or more funicular elements.

In all the embodiments described, flat belts may be used as funicular elements, particularly at the pulleys. In that case, they are advantageously provided to be wound in superposition, i.e. spirally.

In a weaving loom which generally comprises a large number of funicular elements, the assembly of the funicular elements on the pulleys is effected so that the orientation of the removable connection means with respect to the polarities of the magnetic elements of the different actuators, such as the magnets of the rotors or the stator elements, is irregularly distributed. It is also possible to provide an orientation regularly offset by a relatively small pitch, of the order of 3 to 15°. In both cases, this makes it possible to avoid a mechanical or magnetic resonance of the device.

What is claimed is:

1. Process for assembling a funicular element in a device for forming the shed in a weaving loom of a Jacquard type, including the steps of:

providing an electrical rotary actuator;

attaching at least one end of the funicular element on a winding element adapted to receive and wind the funicular element when the winding element is driven by the electrical rotary actuator; and removably connecting the funicular element to the electrical rotary actuator.

2. The process of claim 1, wherein the step of removably connecting consists of connecting one end of said funicular element with a first member of the winding element and in removably mounting said first member on a second member of the winding element secured to the electrical rotary actuator.

3. Device for forming the shed on a weaving loom of Jacquard type, the device comprising:

at least one electrical rotary actuator for driving at least one funicular element around a winding element rotatably connected to said at least one electrical rotary actuator, at least one end of the funicular element being attached to the winding element, and said winding element including removable connection means disposed between the funicular element and said at least one electrical rotary actuator.

4. The device of claim 3, wherein the removable connection means includes a first member provided with at least one means for retaining said at least one end of the funicular element, and a second member connected to a rotor of said electrical rotary actuator, said first and second members being removably assembled to one another.

5. The device of claim 4, wherein the second member is provided with an elastic element resiliently engaging said first member.

6. The device of claim 4, wherein the first and second members are provided with cheeks which are spaced from one another in an assembled position of the first and second members.

7. The device of claim 3, including means for attaching at least two ends of the funicular element to said winding element.

8. The device of claim 7, wherein the funicular element is disposed around an elastically mounted guide pulley which exerts a force of tension on said funicular element, and said two ends being being wound on said winding element in opposite directions.

9. The device of claim 7, wherein two ends of said funicular element are wound about a common winding zone on said winding element.

10. The device of claim 7, wherein said funicular element is connected to a mail for passage of warp yarn.

11. The device of claim 8, wherein a first segment of said funicular element is connected to a position of warp yarns, while a second segment is connected to traverse a lap of warp yarns between said winding element and said guide pulley.

12. The device of claim 3, including means for connecting first ends of each of two distinct funicular elements to said winding element and said two distinct funicular elements being connected to individual tensioning means.

13. The device of claim 3, wherein said winding element is provided with a helicoidal groove for guiding said funicular element in the course of the winding.

14. In a weaving loom of a Jacquard type which includes a shed forming device including at least one funicular element, the improvement comprising, at least one electrical rotary actuator for driving the at least one funicular element about a winding element rotatably connected to the at least one electrical rotary actuator, said winding element including structure adapted to permit attachment of at least one end of the at least one funicular element thereto, and means for removably connecting the at least one end of the at least one funicular element from driving relationship with the at least one electrical rotary actuator.

15. The weaving loom of claim 14, wherein the means for removably connecting includes said winding element having a first member provided with at least one means for retaining said at least one funicular element thereto and a second member connected to a rotor of said at least one electrical rotary actuator, and said means for removably connecting the at least one end of at least one funicular element from driving relationship with the at least one electrical rotary actuator includes structure whereby the first and second members are removably assembled to one another.

16. The weaving loom of claim 15, wherein said second member includes a hub having an elastic element associated therewith for selective engagement with said first member, and a key element associated with said first member for engaging said first member.

17. The weaving loom of claim 14, wherein said at least one electrical rotary actuator includes a rotor and a stator each including elements defining magnetic poles of opposite polarity, and means for orienting a point of connection of the at least one funicular element so as to be angularly offset with respect to said opposite poles of said rotor.

* * * * *